United States Patent [19]

Rosen

[11] Patent Number: 4,934,304

[45] Date of Patent: Jun. 19, 1990

[54] NOVELTY CLIP

[76] Inventor: Jan A. Rosen, 9828 Gloucester Dr., Beverly Hills, Calif. 90210

[21] Appl. No.: 331,188

[22] Filed: Mar. 31, 1989

[51] Int. Cl.[5] ..... B42D 9/00

[52] U.S. Cl. ..... 116/237; 116/234; 281/42; 24/303

[58] Field of Search ..... 40/600, 658, 666, 621; 116/234, 237, 239; 281/42; 24/67.9, 67.11, 303, 545, 563, DIG. 8, DIG. 9; D19/34

[56] References Cited

U.S. PATENT DOCUMENTS

| | | | |
|---|---|---|---|
| D. 38,916 | 12/1907 | Willis | D19/34 |
| D. 89,073 | 1/1933 | Royle | D19/34 |
| D. 235,174 | 5/1975 | Gardner | D19/34 |
| D. 280,529 | 9/1985 | Cox | D19/34 |
| D. 297,334 | 8/1988 | Trent | D19/34 |
| 399,768 | 3/1889 | Mehrer | 116/237 |
| 497,454 | 5/1893 | Muller | 281/42 |
| 793,826 | 7/1905 | Damico | 40/658 |
| 893,353 | 7/1908 | McGill | 24/563 |
| 992,916 | 5/1911 | Shiver | 116/237 |
| 1,874,844 | 8/1932 | Adler | 24/DIG. 9 |
| 1,961,527 | 6/1934 | Petro | 116/238 |
| 2,116,147 | 5/1938 | Haessler | 116/237 |
| 2,344,613 | 3/1944 | Hellstern | 116/237 |
| 2,609,629 | 9/1952 | Hubbard | 116/234 |
| 2,717,572 | 9/1955 | Kingman | 281/42 |
| 3,137,269 | 6/1964 | Sager | 116/237 |
| 3,159,137 | 12/1964 | Baldwin | 281/42 |
| 3,381,654 | 5/1968 | Hupp et al. | 116/237 |
| 3,670,691 | 6/1972 | Anderson | 281/42 |
| 3,756,550 | 9/1973 | Kollitz | 24/303 |
| 4,024,832 | 5/1977 | Machnikowski | 116/237 |
| 4,287,676 | 9/1981 | Weinhaus | 40/600 |
| 4,487,156 | 12/1984 | Frost | 116/239 |
| 4,800,662 | 1/1989 | Belrose | 40/426 |

FOREIGN PATENT DOCUMENTS

| | | | |
|---|---|---|---|
| 425257 | 3/1935 | United Kingdom | 116/237 |

*Primary Examiner*—Allan N. Shoap
*Assistant Examiner*—W. Morris Worth
*Attorney, Agent, or Firm*—Cislo & Thomas

[57] ABSTRACT

A unique clip having a depending body portion with an inner set slit or slot thereby forming a tongue which may be displaced from the plane of the body portion and wherein the terminus may be one of a plurality of configurations and wherein the clip has a myriad of uses, including being used as a bookmark, memo holder, or a paper clip.

14 Claims, 1 Drawing Sheet

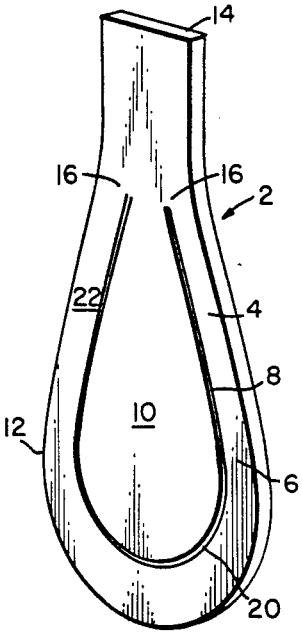
Fig. 1.
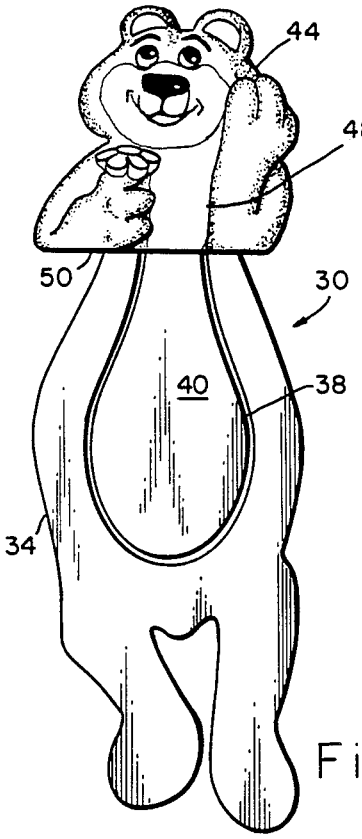
Fig. 2.
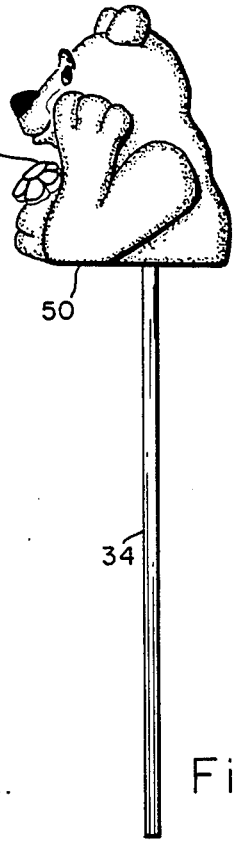
Fig. 3.
Fig. 4.
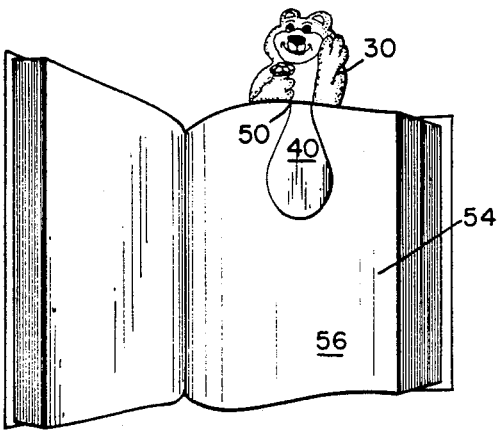
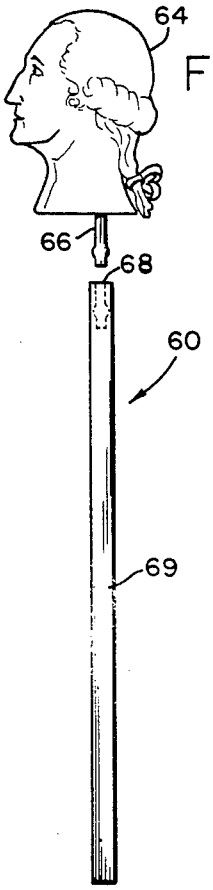
Fig. 5.
Fig. 6.
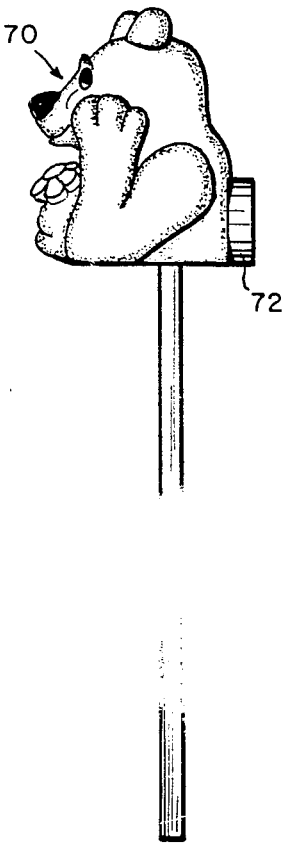
Fig 7.
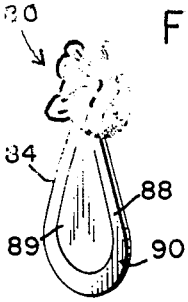

NOVELTY CLIP

BACKGROUND OF THE INVENTION

This invention relates to clips of various kinds that may be used as bookmarkers, memo holders, or clips which provide the same ubiquitous type of fastening as is ordinarily accomplished with conventional paper clips. As one knows when reading a book, it becomes important to be able to mark the place where the reader has stopped reading for the particular time period involved, and in the past various bookmarkers have been suggested which have not necessarily provided a secure manner in which to mark off the place where the reader has stopped reading. That is, ordinary bookmarkers will generally have a planar, elongated member which is merely put into the section of the book intended to be marked without physical attachment to the page. Other bookmarkers, while providing for physical attachment to the page, do not provide a unique way or means of attachment to the page and further would not have, as in some of the embodiments of the invention, unique termini having various configurations. The devices of this invention also allow the users thereof to demonstrate their likes or dislikes with respect to the conventional and ubiquitous items normally encountered in everyday life. By that it is meant that the securement members or clips of the invention may be fashioned into a myriad of aesthetically pleasing shapes to reflect the users likes or dislikes or even character.

The unique clips of the invention are peculiarly adaptable for appealing to the fancies of youngsters. By that it is meant that the securement means, whether they be used for memo holders, bookmarkers, or just paper clips, will bring to the child user a new dimension allowing the child to choose from a large variety of clips which may be configured into child pleasing configurations.

A search in the United States Patent Office has revealed the following patents:

| U.S. PAT. NO. | INVENTOR | ISSUE DATE |
|---|---|---|
| 399,768 | H. L. Mehrer | Mar. 19, 1889 |
| 793,826 | N. E. Damico | July 4, 1905 |
| 38,916 | H. M. Willis | Dec. 3, 1907 |
| 893,353 | G. W. McGill | July 14, 1908 |
| 992,916 | J. B. Shriver | May 23, 1911 |
| 2,116,147 | M. Haessler | May 3, 1938 |
| 2,344,613 | L. A. Hellstern | Mar. 21, 1944 |
| 3,137,269 | L. B. Sager | June 16, 1964 |
| 3,159,137 | F. S. Baldwin | Dec. 1, 1964 |
| 3,381,654 | R. E. Hupp et al | May 7, 1968 |
| 235,174 | Lee R. Gardner | May 27, 1975 |
| 4,487,156 | Barry J. Frost | Dec. 11, 1984 |
| 297,334 | Marty C. Trent | Aug. 23, 1988 |

While the foregoing patents describe various clips and devices including bookmarks, none have the unique combination of features as provided in the instant invention.

SUMMARY OF THE INVENTION

The invention is directed to a unique clip taking various ultimate configurations depending upon the market being sought, but wherein the basic, underlying element is an elongated, curvilinear or tear-drop member having a curvilinear slot defining a depending tongue, which is adapted to retain a sheet of paper or the like between the depending tongue and the peripherally extending body portion of the remainder of the clip. In another embodiment of the invention, an abutment stop is positioned so as to provide a limit so that the clip is prevented from further engagement with the sheet of paper or the like, with which it is associated. In modified forms, the invention includes a uniquely configured and aesthetically pleasing selected figure on the terminus of the clip forming the abutment stop, whether it be a cartoon animal, sports representation, or an article of clothing or the like depending on one's choice and the market sought for the particular chosen configuration.

It is an object of the present invention to provide a unique clip.

Another object of the invention is to provide a unique, clip bookmarker which has a specific configuration to allow ease of use and to prevent disassociation with the book page, for example, with which the clipmarker may be utilized.

It is still another, further, important object of the invention to provide a unique clip having an aesthetically pleasing terminus, wherein one of a plurality of different configurations may be utilized.

It is still another, even more and further important object of the invention, to provide, in a particular embodiment, a one-piece, clip member that may be utilized for a variety of uses and wherein the one-piece, clip member has an elongated, tear-drop body with an inner set, congruently shaped slot forming a depending tongue, which co-acts with the surrounding body portion to provide a clipping or securing action for a piece of paper or the like.

It is still a more specific and important object of the invention to provide a bookmarker clip having one of a plurality of different configurations wherein the clip emulates one of a number of different aesthetically pleasing designs.

It is still another more important and specific object of the invention to provide a unique clip member having means by which paper or the like may be held and wherein the clip has a magnetic member for attachment to metal surfaces.

It is still an even more important and specific object of the invention to provide a unique clip which employs a two-piece construction, so that the clip may have one of a plurality of termini associated therewith depending on the desire of the user.

These and other objects and features of the present invention will become apparent from the following detailed description taken in conjunction with the accompanying drawings wherein like numerals of reference designate like elements throughout.

BRIEF DESCRIPTION OF THE DRAWINGS

FIG. 1 is a perspective view of the simplest embodiment of the unique clip of the invention;

FIG. 2 is a front view of one of the embodiments of the unique clip of the invention, ideally suited for bookmarking functions, and wherein the terminus has a child pleasing configuration;

FIG. 3 is a side elevational view of FIG. 2;

FIG. 4 is a schematic illustrating how the embodiment of the invention depicted in FIG. 2 may be associated with a book or the like;

FIG. 5 illustrates an embodiment of the invention wherein the unique clip is made up of two components wherein the upper or the terminus component is interchangeable;

FIG. 6 is a side view of another embodiment of the invention, wherein the unique clip of the invention is provided with a magnet for attachment to metal surfaces;

FIG. 7 is a perspective view of a small size paper clip having a terminus modified so as to better accommodate the conventional use of a paper clip.

DETAILED DESCRIPTION OF THE INVENTION

Referring to the figures of drawings, it will be noted that in the primary embodiment of the invention as depicted in FIG. 1, the unique clip 2 is of a integral construction and in this particular instance, has a body member 4 of relatively thin, plastic material and has a depending tear-drop portion 6 with an inner set slot or cut 8, in the body portion 4, so that a depending tongue like portion 10 is formed. The slot or cut 8 is generally of congruent configuration to the outer periphery 12 of body member 4. The uppermost or terminus 14 of clip 2 is tabular-like in configuration so as to provide ease of grasping the clip 2.

The opposed termini 16 of slot 8 provide an abutment stop for paper, for example, with which clip 2 may be associated. In this particular instance the clip 2 is integrally constructed of molded plastic of the type that would be somewhat pliable such that the tongue portion 10, fashioned by reason of the slit or slot 8, may be displaced out of the plane of the contiguous body portion 4 so as to provide a receiving recess 20 which permits the clip 2 to be frictionally retained, for example, on a sheet of paper (not shown) by reason of the cooperation of the tongue 10 and the surrounding portion 22 of body 4. Thus, it is clearly seen that the clip 2 may be frictionally retained on one or more sheets of paper to act either as a bookmarker or a member for releasably securing one or more sheets of paper together.

Referring to FIGS. 2, 3, and 4, another embodiment of the invention is depicted, wherein, in this instance, the clip 30 has a depending body portion 34 configured as a cartoon animal and having a lower configuration to simulate or emulate the body and legs of the animal depicted. The tear-drop configuration for example of the animal depicted is quite apparent with the slit or slot 38 being provided so that tongue-like portion 40 is formed for the same purpose, as previously described with respect to clip 2.

In this particular embodiment the upper terminus 44 is configured as the head of the animal or the bear shown and the frontal bear portion 48 of clip 30 has a substantially planar under surface 50 to which the slot or slit 38 extends, thereby providing an abutment or stop surface beyond which the clip 30 can no longer be disposed upon a sheet or sheets with which the clip 30 is associated.

For example, referring to FIG. 4 it is clear that the clip 30 is associated with one or more pages of the book 54 and that the tongue 40 is disposed on the front side 56 of the book page, while the surrounding body portion 34 (not seen) is in contact with the obverse side of the page. It will be noted that the upper end of the slot or slit 38, in conjunction with the abutment surface 50, is associated with the book page so that the clip 30 is releasably and frictionally retained therewith, thereby allowing for the book to be closed and still properly marked where the reader has left off. Additionally, the bookmark provides an aesthetically pleasing appearance and not only serves to mark the place where the reader of the book has left off, but also clearly identifies the book as that of the reader.

While in this particular instance, a bear or the like has been depicted, it should be clear to all that various animals, sporting figures, or any configuration may be utilized just so long as the cooperation of the tongue and body portion is maintained to achieve the clip or marking functions intended. To that end, it is important that the depending, figure-like body portions be sufficiently extending or long so as to be able to provide the inner set elongated slit or slot which forms the depending tongue so as to be able to cooperate with the surrounding body, over a sufficiently large area, to provide the friction fit retention between the displaced or flexed out tongue portion and the surrounding body portion. Additionally, while molded plastic is the preferred material of construction, other materials may suffice just so long as the pliability or ability to move or displace the tongue portion from the plane of the surrounding body is obtained, so as to form the cooperative receiving recess for the paper or the like material to be retained within the recess of the clip.

Referring now to FIG. 5, a clip or bookmark 60 is illustrated which is, for all practical purposes, identical in construction to the clip 30 except in this particular instance, the upper portion or terminus 64 is separately constructed with a depending peg member 66 adapted to be snap-fitted into the aperture, slot or hole 68, such that one of a plurality of heads or termini 64 may be associated with the lower body portion 69 which may take one of a variety of configurations so as to be compatible with the configuration of the terminus or head 64 selected for association with the body 69. For example, if the body portion 69 was configured as the body of a man and the upper terminal portions were to be one of a plurality of heads, as say might come from the Mount Rushmore Monument, the clip 60 would allow the user thereof to select a Lincoln head, for example, for association with the body or ultimately a Washington head for association with the body. Obviously, as previously indicated, it is important that the body portion have the depending tongue configuration and the general overall tear-drop configuration to achieve the functional purposes set forth hereinbefore.

Referring now to FIG. 6, a clip 70, generally of the same type as shown in FIGS. 2 and 3, is depicted as having a magnet 72 associated therewith so that clip 70 may be placed on a metal surface such as a refrigerator door, thereby allowing the clip 70 to be used as a memo or the like holder. In this particular instance, instead of the depending tongue-like portion being associated with a page in a book, a memo sheet would be placed in retained fashion to alert someone approaching the refrigerator of a message or the like.

Referring to FIG. 7, this embodiment of the invention shows the clip 80 of miniaturized or smaller size of the type normally associated with paper clips for holding sheets of paper together in a unique fashion. Here again, the lower body portion 84 is provided with the congruently shaped slit or slot 88 so that a retention recess is formed with the tongue 89 and the depending body portion 90. In this particular instance, the clip 80 has a somewhat flattened or smaller head portion so as to be easily associated with one or more sheets of paper.

It will be apparent that numerous variations and modifications can be made to the herein described embodiment of the present invention, without departing from the scope thereof. Therefore it should be clearly understood that the form of the present invention described above and shown in the accompanying drawing is illustrative only and is not intended to limit the scope of the invention.

I claim:

1. A multi-purpose clip for engaging one or more of a plurality of adjacent planar elements, comprising the combination of:

a one-piece body member of depending tear-drop configuration and having an upper terminus with at least one substantially nonplanar major lateral surface; said body member including a lower portion having a planar contour with a pair of opposing surfaces, said lower portion having an inner set, continuous, curvilinear slot similar in shape to the configuration of said depending body member thereby forming a depending tongue-like portion, said slot having termini at a proximal end of said tongue-like portion, said upper terminus having a portion adjacent said termini of said slot forming a planar abutment surface extending substantially orthogonal to and extending a predetermined distance from said pair of opposing planar surfaces and extending in a direction transverse to said planar surfaces a predetermined distance beyond said curvilinear slot termini; the material of construction of said clip being such that said tongue-like portion may be displaced from the plane of the depending body member to thereby form a recess or the like to receive said one or more planar elements in releasable, friction fit relationship, whereby said abutment surface contacts end surface portions of said one of said plurality of planar elements and other planar elements disposed adjacent said pair of opposing planar surfaces thereby serving as a stop beyond which said clip can no longer be disposed upon said one or more planar elements.

2. The clip in accordance with claim 1 wherein said material of construction is plastic.

3. The clip in accordance with claim 2 wherein said upper terminus is shaped to replicate one of a plurality of configurations selected from animals, cartoon characters, historical characters, and articles.

4. The clip in accordance with claim 2 wherein said body member is of sufficient size to form a sufficiently large recess so that said tongue-like portion and the said surrounding depending body member cooperate to releasably and frictionally retain a sheet of paper or the like therebetween.

5. The clip in accordance with claim 4 wherein said clip has a magnetic element secured thereto.

6. The clip in accordance with claim 3 wherein said depending body member has a lowermost portion configured as a lower body of the character of the selected one of said plurality of configurations.

7. The clip in accordance with claim 6 wherein said clip is of molded plastic.

8. The clip in accordance with claim 7 wherein said clip is disposable on one or more of a plurality of pages of a book and said tongue-like portion is placeable on either side of one or more pages relative to of said body member.

9. The clip in accordance with claim 1 wherein said upper terminus is removable, and said lower portion is provided with a hole and said upper terminus defining a head portion having a selected configuration with a depending peg which is adapted to be releasably and frictionally retained in said hole.

10. A multi-purpose clip comprising the combination of:

a one-piece body member of depending tear-drop configuration and having an upper terminus; said body member including a lower portion having an inner set, continuous, curvilinear slot similar in shape to the shape of said depending body member thereby forming a depending tongue-like portion, said slot having termini at a proximal end of said tongue-like portion; the material of construction of said clip being such that said tongue-like portion may be displaced from a plane defined by a portion of said body member surrounding said tongue-like portion of said depending body member to thereby form a recess or the like to receive a planar element in releasable, friction fit relationship;

wherein said clip comprises a plastic material;

wherein said upper terminus is shaped to replicate one of a plurality of configurations selected from animals, cartoon characters, historical characters, and articles;

wherein said body member is of sufficient size to form a sufficiently large recess so that said tongue-like portion and said portion of said body member surrounding said tongue-like portion cooperate to releasably and frictionally retain at least one sheet of paper or the like therebetween; and wherein said upper terminus has a head configuration and the portion of said terminus adjacent the termini of said slot forms a substantially planar abutment surface extending substantially orthogonal to and extending a predetermined distance from said plane of said portion of body member surrounding said tongue-like-portion and extending transversely a predetermined distance beyond said termini of said slot, whereby said abutment surface contacts an edge surface portion of said at least one sheet of paper to thereby serve as a stop beyond which said clip can no longer be disposed upon said at least one sheet of paper.

11. The clip in accordance with claim 10 wherein said clip has a magnetic element secured thereto.

12. The clip in accordance with claim 10 wherein said depending body member has a lowermost portion configured as a lower body of the character of the selected one of said plurality of configurations.

13. The clip in accordance with claim 10 wherein said clip is disposable on one or more of a plurality of pages of a book and said tongue-like portion is placeable on either side of one or more pages relative to the portion of said body member surrounding said tongue-like portion.

14. The clip in accordance with claim 10 wherein said upper terminus is removable, and said lower portion is provided with a hole and said upper terminus defining a head portion having a selected configuration with a depending peg which is adapted to be releasably and frictionally retained in said hole.

* * * * *